US011799211B2

(12) United States Patent
Sazegar et al.

(10) Patent No.: US 11,799,211 B2
(45) Date of Patent: Oct. 24, 2023

(54) MULTIBAND GUIDING STRUCTURES FOR ANTENNAS

(71) Applicant: Kymeta Corporation, Redmond, WA (US)

(72) Inventors: Mohsen Sazegar, Kirkland, WA (US); Chris Eylander, Redmond, WA (US); Aidin Mehdipour, Redmond, WA (US); Ibrahim Nassar, Redmond, WA (US); Bradley Eylander, Kent, WA (US)

(73) Assignee: KYMETA CORPORATION, Redmond, WA (US)

( * ) Notice: Subject to any disclaimer, the term of this patent is extended or adjusted under 35 U.S.C. 154(b) by 0 days.

(21) Appl. No.: 18/075,166

(22) Filed: Dec. 5, 2022

(65) Prior Publication Data

US 2023/0238711 A1 Jul. 27, 2023

Related U.S. Application Data

(63) Continuation of application No. 17/131,133, filed on Dec. 22, 2020, now abandoned.

(60) Provisional application No. 62/954,959, filed on Dec. 30, 2019.

(51) Int. Cl.

| | |
|---|---|
| ***H01Q 21/00*** | (2006.01) |
| ***H01Q 15/04*** | (2006.01) |
| ***H01Q 15/00*** | (2006.01) |
| ***H01Q 5/55*** | (2015.01) |

(52) U.S. Cl.

CPC ..... *H01Q 21/0037* (2013.01); *H01Q 5/55* (2015.01); *H01Q 15/0086* (2013.01); *H01Q 15/04* (2013.01)

(58) Field of Classification Search

CPC ..... H01Q 21/0037; H01Q 21/0043; H01Q 21/005; H01Q 21/0062

See application file for complete search history.

(56) References Cited

U.S. PATENT DOCUMENTS 10,811,784 B2 * 10/2020 Sikes ..... H01Q 1/48

* cited by examiner

*Primary Examiner* — Daniel Munoz

(74) *Attorney, Agent, or Firm* — Womble Bond Dickinson (US) LLP

(57) ABSTRACT

Multiband guiding structures for antennas and methods for using the same are described. In one embodiment, an antenna comprises: an antenna aperture with radio-frequency (RF) radiating antenna elements; and a center-fed, multi-band wave guiding structure coupled to the antenna aperture to receive a feed wave in two different frequency bands and propagate the feed wave to the RF radiating antenna elements of the antenna aperture.

23 Claims, 15 Drawing Sheets

Iris L2

Iris L1

Patch and Iris L1

Top View

MULTIBAND GUIDING STRUCTURES FOR ANTENNAS

PRIORITY

The present application is a continuation of U.S. patent application Ser. No. 17/131,133, filed Dec. 22, 2020, and entitled "MULTIBAND GUIDING STRUCTURES FOR ANTENNAS," which claims the benefit of U.S. Provisional Patent Application No. 62/954,959, filed Dec. 30, 2019 and entitled "MULTIBAND GUIDING STRUCTURES FOR RECONFIGURABLE HOLOGRAPHIC ANTENNAS", which is incorporated by reference in its entirety.

FIELD OF THE INVENTION

Embodiments of the invention are related to wireless communication systems; more particularly, embodiments of the invention are related to antennas for wireless communication that have wave guiding structures that propagate multiband waves.

BACKGROUND

Consumer and commercial demand for connectivity to data and media is increasing. Improving connectivity can be accomplished by decreasing form factor, increasing performance, and/or expanding the use cases of communication platforms. Satellite communication is one context where there has been an expansion of use case, particularly with mobile platforms. For example, where satellite communication is delivered to a mobile platform (e.g., automobile, aircraft, watercraft), both the satellite and the mobile platform may be moving.

Prior approaches use a waveguide and splitter feed structure to feed antennas such as satellite antennas. Ando et al., "Radial line slot antenna for 12 GHz DBS satellite reception", and Yuan et al., "Design and Experiments of a Novel Radial Line Slot Antenna for High-Power Microwave Applications", discuss various antennas. The feed structures described in the papers are folded, dual layer, where the first layer accepts the pin feed and radiates the signal outward to the edges, bends the signal up to the top layer and the top layer then transmits from the periphery to the center exciting fixed slots along the way. Finally, an absorber terminates whatever energy remains.

Some antennas have realized a single commercial band e.g., Ku or Ka and have been done so on a center-fed or edge-fed guide structure.

SUMMARY

Multiband guiding structures for antennas and methods for using the same are described. In one embodiment, an antenna comprises: an antenna aperture with radio-frequency (RF) radiating antenna elements; and a center-fed, multi-band wave guiding structure coupled to the antenna aperture to receive a feed wave in two different frequency bands and propagate the feed wave to the RF radiating antenna elements of the antenna aperture.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Figure 1A:
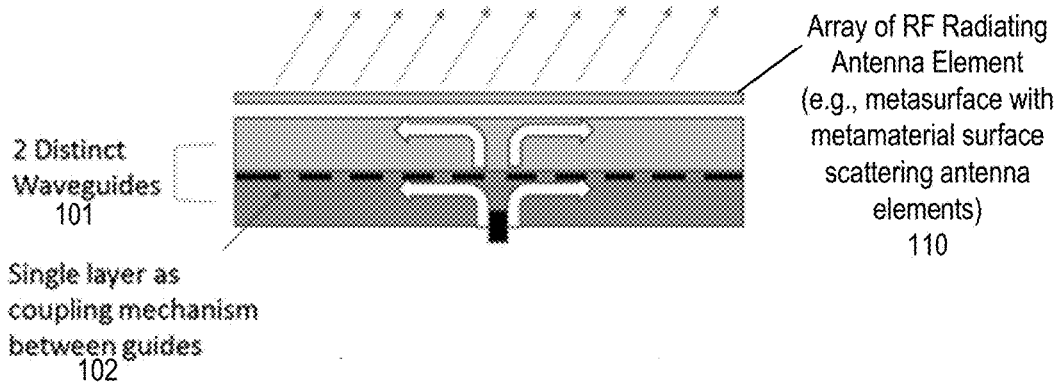
FIG. 1A illustrates a side section view of a center-fed two waveguide design.

Methods and devices for enhancing capabilities in guiding structures to support multi-band antennas (e.g., Ku and Ka bands). In one embodiment, the antennas are used in a satellite communication system. In one embodiment, the antennas are part of satellite terminals. The guiding structures enable propagation of feed waves having multi-bands to interact with antenna elements in an array of antenna elements that are part of an antenna. In one embodiment, the antennas include an array of radio-frequency (RF) radiating antenna elements. The array of RF radiating antenna elements may be part of a metasurface having metamaterial surface scattering antenna elements. Examples of such RF radiating antenna elements and such antennas are described in more detail below. Note that the methods and devices described herein are not limited to the antenna elements described herein.

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

In one embodiment, the guiding structures include center-fed, multi-band guiding structures and hybrid center-fed/edge-fed multi-band guiding structures. These structures include one or more innovations that are described herein.

In one embodiment, the center-fed single layer multi-band directional coupler guiding structure includes a directional coupler with a complex filter response to achieve desired coupling coefficients at two bands that are separated in frequency. This is in contrast to directional couplers that are either capacitive or inductive having either high pass or low pass filter responses. By engineering the filter response at two bands instead of a single band, the center-fed single layer multi-band directional coupler guiding structure provides more control of aperture distribution and power transfer. Also, by combining desirable attributes of capacitive or inductive directional couplers, a pass band or band reject filter can be used to obtain benefits of both. Furthermore, in one embodiment, as the frequency of operation changes with respect to the resonance of the coupling element, the spatial filter response of the directional coupler changes.

In one embodiment, the two bands for which the directional coupler achieves desired coupling are separated far (e.g., 2.5 GHz, etc.) in frequency. The separation in frequency, may be, for example, but not limited to, a frequency separation like that of the Ka and Ku bands. Alternatively, the two bands may comprise one or more other satellite communication (satcom) bands.

In one embodiment, a center-fed single band high frequency, edge-fed single band low frequency guiding structure uses center-fed guide operation to support a high frequency band and edge-fed guide operation to support a low frequency band. This is in contrast to antennas that are either edge-fed or center-fed. The center-fed single band high frequency, edge-fed single band low frequency guiding structure provides mechanical simplification of the feed since the edge-fed chamfer only has to support one frequency band. Also, if the higher frequency active aperture is smaller than the lower frequency active aperture, there would not be excess loss due to unutilized waveguide length, thereby an extra degree of freedom to size both the high and low frequency apertures.

In one embodiment, a center-fed single band low frequency, edge-fed single band high frequency guiding structure uses edge-fed guide operation to support a high frequency band and center-fed guide operation to support a low frequency band. This is in contrast to antennas that are either edge-fed or center-fed. With the center-fed single band low frequency, edge-fed single band high frequency guiding structure, the lowest frequency band typically radiates more per length. This makes it a challenge to maintain high aperture efficiency at low frequencies when using an edge-fed guiding structure. By center-feeding the low frequency band, the aperture distribution could be tailored specifically to the higher radiation rates.

In one embodiment, a center-fed multi-layer guide multi-band directional coupler guiding structure uses two layers with impedances separated by some distance, three guiding structures could be realized, creating a separate spatial frequency response for two bands that are separated far in frequency. This is in contrast to directional couplers that use a single layer coupling structure between two waveguides. In one embodiment, the center-fed multi-layer guide multi-band directional coupler guiding structure provides more control of aperture distribution and power transfer by engineering the filter response at two bands instead of a single band.

In one embodiment, a center-fed single layer tunable directional coupler has coupling elements with a size that may be changed electrically or physically to dynamically change the spatial filter response of the directional coupler. This would enable dynamic reconfiguration of the coupling coefficients to either the high or low frequency band. This is in contrast to directional couplers that have a coupling element that is not tunable. A challenge in many cases is to design a low pass or high pass coupler that yields desired aperture distribution characteristics when ratio of frequency bands exceed 1.3. If the switching speed of the tunable coupler is fast enough, the coupler can adapt to optimally support receive (Rx) and transmit (Tx) bands used in half duplex mode. State of the art networks such as Starlink are designed to support half duplex mode operation. In one embodiment, the center-fed single layer tunable directional coupler provides dynamic control of aperture distribution and power transfer.

One of more advantages with the above-described embodiments are given below.

Prior to discussing the multi-band guiding structure designs, center-fed and edge-fed guiding structures will be described.

FIG. 1A illustrates a side section view of a center-fed two waveguide design. In one embodiment, center-fed two waveguide design is cylindrical when viewed from the top. Referring to FIG. 1A, the center-fed two waveguide design that contains two distinct waveguides 101 with a single layer coupling mechanism 102 between waveguides 101. In this design, a feed wave feed into the bottom of the bottom waveguide of waveguides 101 propagates in the bottom waveguide and couples to the top waveguide of waveguides 101 by use of single layer coupling mechanism 102 to enable the feed wave to interact with radio-frequency (RF) radiating antenna elements of an array 110 that is above the top waveguide of waveguides 101. In one embodiment, array 110 of RF radiating antenna elements comprise a metasurface with metamaterial surface scattering antenna elements.

Figure 1B:
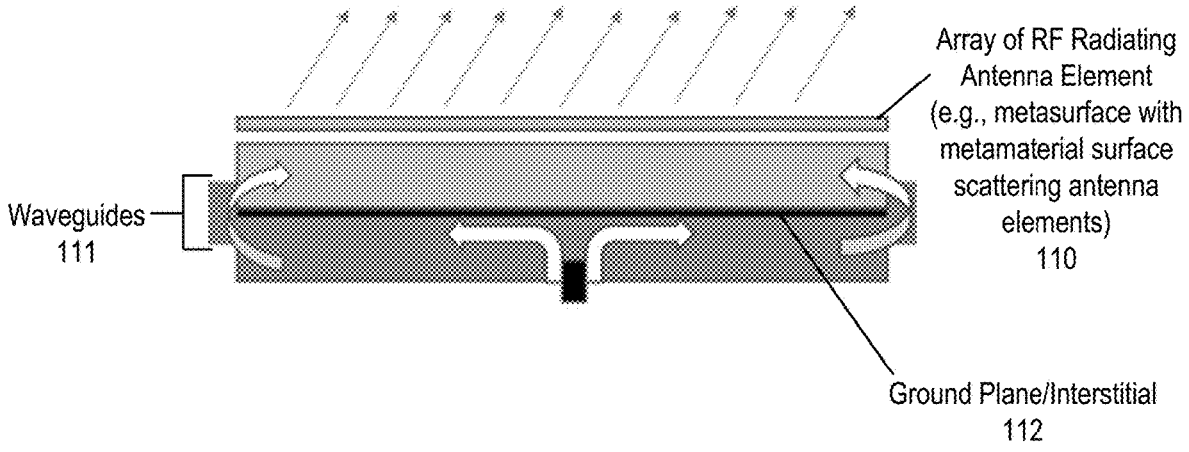
FIG. 1B illustrates an edge-fed two waveguide design

FIG. 1B illustrates an edge-fed two waveguide design. In one embodiment, edge-fed two waveguide design is cylindrical when viewed from the top. Referring to FIG. 1B, the edge-fed two waveguide design includes two waveguides 111 with a ground plane or interstitial 112 between the two waveguides. An array 110 of RF radiating antenna elements (e.g., a metasurface with metamaterial surface scattering antenna elements, etc.) is above the top waveguide of waveguides 111. When using the edge-fed two waveguide design, a feed wave is fed into the bottom waveguide and propagates the bottom waveguide radially outward from the feed port to the edges of the bottom waveguide. Upon reaching the edge of the bottom waveguide, the feed wave propagates around ground plane/interstitial 112 at the bend areas at the edge and propagates into the top waveguide. Once the feed wave is in the top waveguide, the RF energy of the feed wave can interact and excite the RF radiating antenna elements in the RF array 110.

Figure 2A:
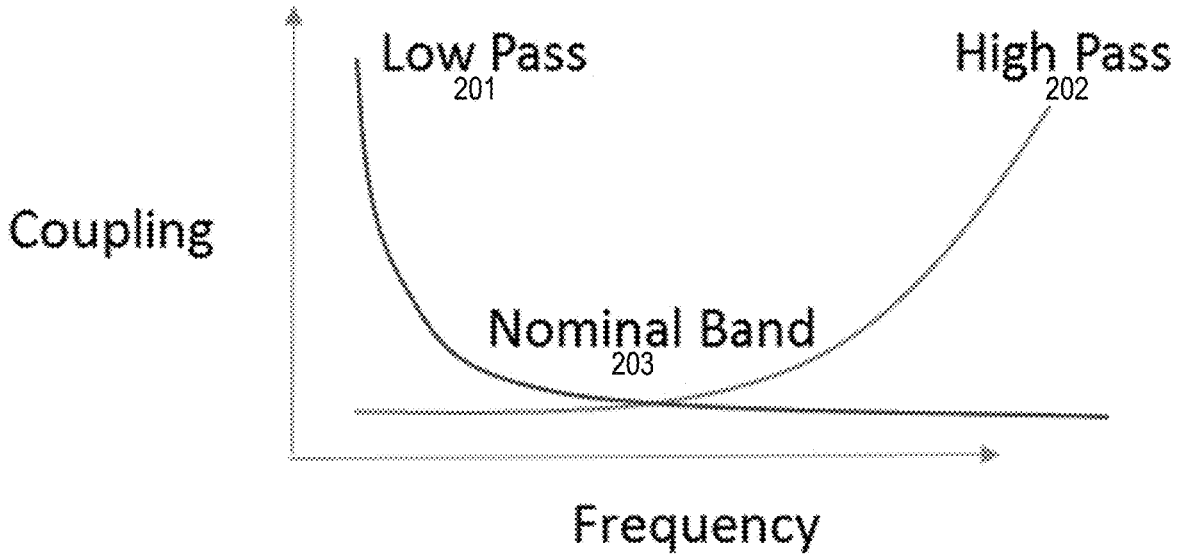
FIG. 2A illustrates the frequency responses for coupling between bottom and top wave guides based on frequency.

Existing center-fed directional coupler element design have frequency responses where the coupling coefficients from bottom guide to top guide is either low pass or high pass. FIG. 2A illustrates the frequency responses for coupling between bottom and top wave guides based on frequency. Referring to FIG. 2A, the coupling from the bottom waveguide to the top waveguide allows the band 201 with a low pass frequency in one design, while the coupling from the bottom waveguide to the top waveguide allows the band 202 with a high pass frequency to pass in another design (with the nominal band 203 in between).

Figure 2B:
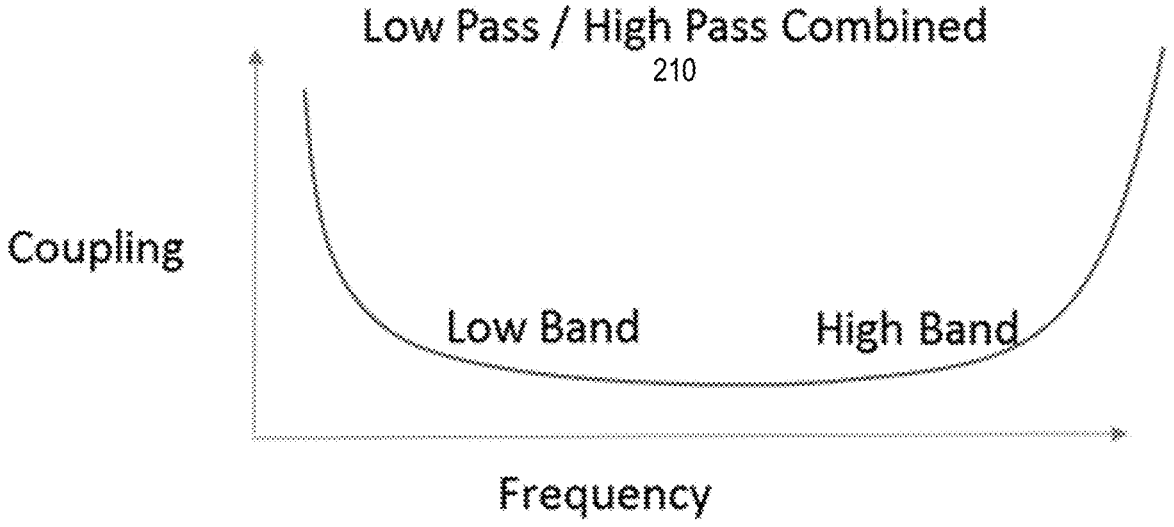
FIG. 2B shows an example of the result of modifying the coupling rate to change the impedance characteristics of the directional coupler.

By changing the impedance characteristic of the directional coupler element (e.g., designing it for certain bands), the filter response could be designed for both high and low frequency bands. For example, in one embodiment, the coupling rate is modified to change the impedance characteristic as well as the frequency for which it is designed. In one embodiment, the coupling rate is modified by changing hole size, slot size, or any adjustment to the coupling leaking elements. In one embodiment, the impedance characteristic is modified by combining both inductive and capacitive elements in close proximity. There are many surface impedance structure in the literature that performance band pass or band reject filter responses. FIG. 2B shows an example of the result of modifying the coupling rate to change the impedance characteristics of the directional coupler. This allows better control of the coupling at both bands that are separated far in frequency. For bands separated far in frequency, the coupling coefficients typically drift to far from the nominal coefficient value.

FIG. 2B illustrates a coupler in which the filter response allows for both a low pass band and the high pass band to be coupled from a bottom guide to a top guide in a multi-layered guiding structure. Thus, in this case, the low pass band and high pass band combined 210 are coupled from the bottom waveguide to the top waveguide in a two-waveguide guiding structure. In one embodiment, it is desirable that this frequency of the bands be far enough away to facilitate both the high pass and low pass from being coupled from the bottom guide to the top guide. In one embodiment, the low pass is to Ku band while the high pass is to Ka band. In such a case, the separation between the highest frequency of the Ka band, namely 14.5 GHz, and the lowest frequency of the Ka band, namely 17.7 GHz, is 2.5 GHz. This is large enough to permit coupling of both the high pass and low pass from a bottom waveguide to a top waveguide.

In one embodiment, the guiding structure is a center-fed multilayer guide, multi-band directional coupler guiding structure. This structure has the same advantage as center-fed single layer multi-band directional coupler guiding structure described in conjunction with FIG. 2B. This is an alternate implementation in which multiple guides are used instead of a single layer, multiple layers.

Figure 3A:
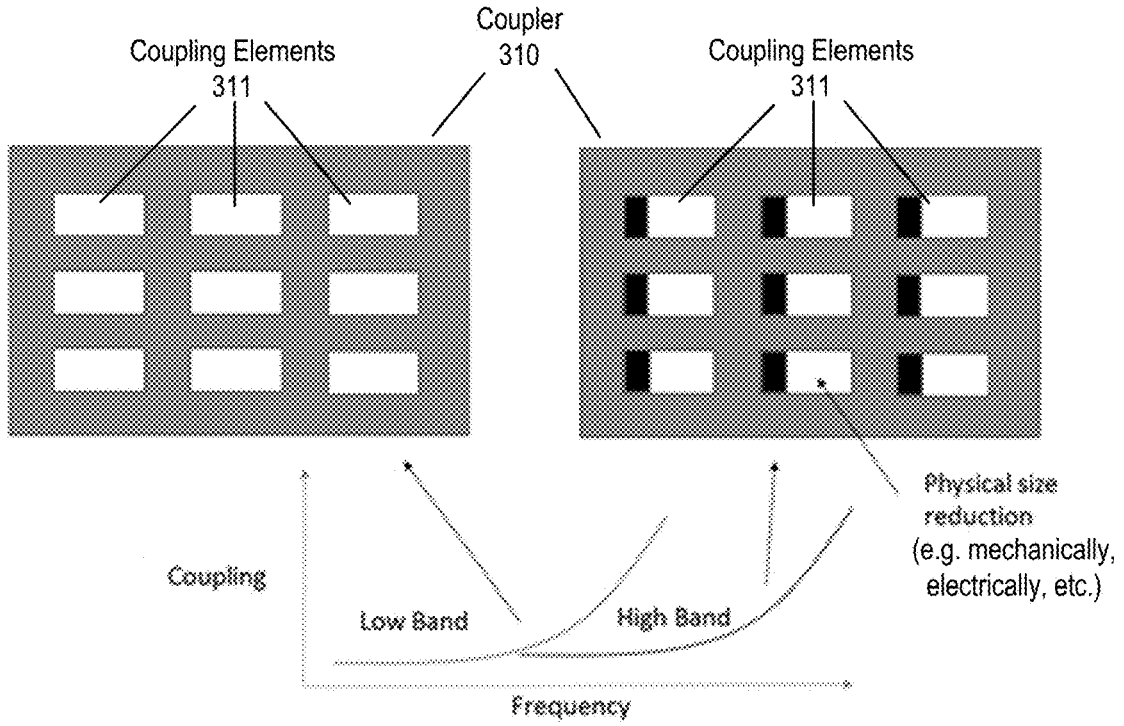
FIG. 3A is an example of physical size reduction of coupling elements (e.g., slots) of a coupler to change its associated coupling.

In one embodiment, the guiding structure is a center-fed single layer tunable directional coupler. With this structure, by changing the electrical or physical size of the coupling element (e.g., a slot), the spatial filter response of the directional coupler is changed. In one embodiment, the electrical or physical size of the coupling element is changed by tuning the capacitance (where capacitors have been included with the coupler). Changing the spatial filter response of the directional coupler would enable dynamic reconfiguration of the coupling coefficients to either the high or low frequency band so that the coupler is able to couple the high or low frequency band from a waveguide (e.g., a bottom waveguide) on one side of the coupler to a waveguide (e.g., a top waveguide) on the other side of the coupler. FIG. 3A is an example of physical size reduction of coupling elements (e.g., slots) of a coupler to change its associated coupling.

Referring to FIG. 3A, coupler 310 includes coupler elements 311 (e.g., slots). Coupler elements 311 include a number of slots. In one embodiment, coupler 310 is designed to permit the passing of a low band, while in another implementation coupler 310 is designed to permit the passing of a high band (high in comparison to the low band). In one embodiment, the coupling elements are reduced in size. In one embodiment, the coupling elements are reduced in size physically. This may be done mechanically. For example, coupler 310 may include 2 layers that can be moved with respect to each other to adjust the size of the coupling elements (e.g., slots/windows). In another embodiment, the electrical length of the windows of the coupling elements 311 are modified electrically. This can be done, for example using capacitive-based couplers. A tunable patch, similar to that of the radiating elements, could be used to control coupling. The dielectric could be a tunable dielectric or could be varactor or alternative.

Figure 3B:
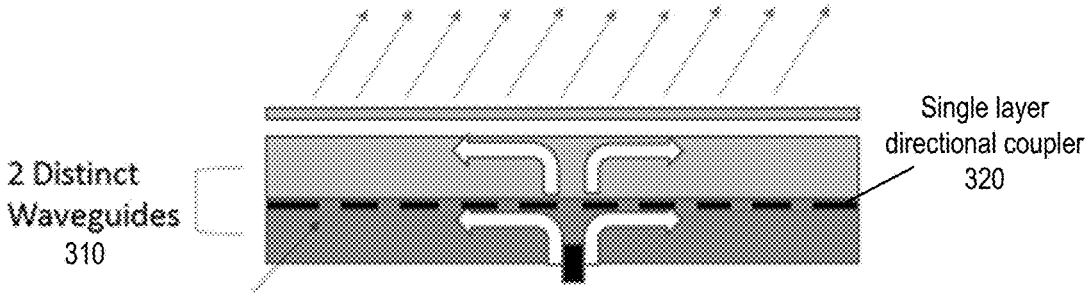
FIG. 3B illustrates a side section center-fed tunable directional coupler-based guiding structure.

FIG. 3B illustrates a side section center-fed tunable directional coupler-based guiding structure. In one embodiment, center-fed tunable directional coupler-based design is cylindrical when viewed from the top. In one embodiment, the coupling layer in this design can be adjusted dynamically.

Referring to FIG. 3B, a single layer directional coupler 320 is between two waveguides and acts as a single layer coupling mechanism. The wave fed propagating cylindrically outward from a center feed in the bottom waveguide of waveguides 310 couples to the top waveguide of waveguides 310 by use of directional coupler 320. In one embodiment, the coupling layer of single layer directional coupler 320 can be adjusted dynamically to enable coupling of the wave to the top waveguide.

Figure 4A:
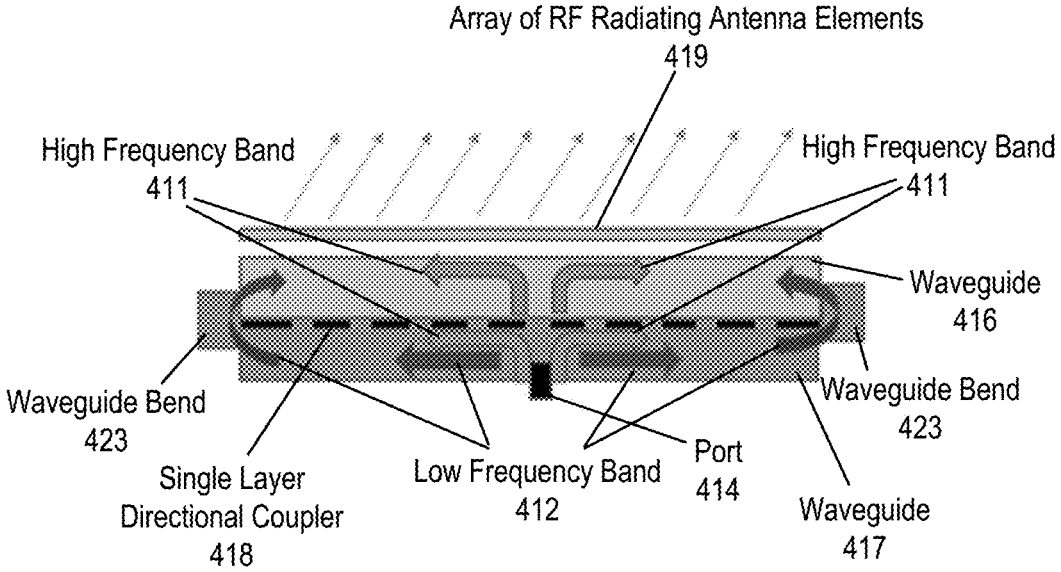
FIG. 4A is a side section view illustrating one embodiment of center-fed, single-band high frequency, edge-fed single band low frequency guiding structure.

In one embodiment, the guiding structure is a center-fed, single-band high frequency, edge-fed single band low frequency guiding structure. FIG. 4A is a side section view illustrating one embodiment of center-fed, single-band high frequency, edge-fed single band low frequency guiding structure. In one embodiment, center-fed, single-band high frequency, edge-fed single band low frequency guiding structure is cylindrical when viewed from the top.

As shown, to the low frequency band, single layer directional coupler 418 is going to look like a continuous plate and is not going to couple through the center-fed guide because the coupling holes are relatively small. At the higher frequency, there is coupling though the single layer of single layer directional coupler 418.

Referring to FIG. 4A, an array of RF radiating antenna elements 419 is above two waveguides, namely waveguide 416 and waveguide 417, which is below waveguide 416. A singular directional coupler 418 is between waveguides 416 and 417. The arrangement also includes waveguide bend areas 423 on both sides of the aperture. In one embodiment, a feed wave having a low frequency band (e.g., Ku band) and high frequency band (e.g., Ka band) is provided via single port 414 into the lower wave guide 417. In one embodiment, the high frequency and low frequency bands are overlaid together and provided to port 414. In one embodiment, this is done in the RF chain. However, a combiner may be used to combine the high and low frequency bands into one feed wave so that they can be provided to a single port, namely port 414.

To the low frequency band, single layer directional coupler 418 is going to look like a continuous plate and is not going to couple through the center-fed guide because the coupling holes are relatively small. At the higher frequency, there is coupling though the single layer of single layer directional coupler 418. The low frequency band 412 in the feed wave propagates radially outward from port 414 towards the edges of waveguide 417 and bends at waveguide bends 423 around directional coupler 418 to propagate into the upper wave guide 416. At the same time, high frequency band 411 couples from lower waveguide 417 into upper waveguide 416 through directional coupler 418. In one embodiment, single layer directional coupler 418 is implemented with a capacitive-based coupler that allows the high frequency band to be coupled and the low frequency band to not be coupled, so the low frequency band propagates via the edge-fed path. Thus, directional coupler 418 is designed to propagate the high frequency band so that the high frequency band traverses directional coupler 418 in a center-fed manner while the low frequency band 412 traverses waveguides 416 and 417 through an edge-fed path. In other words, the path of low frequency band 412 traverses waveguides 416 and 417 as an edge fed design, while the path of the high frequency band is to traverse the center-fed guide. In this way, the feed wave with both low and high frequency bands is able to interface with the RF radiating antenna elements (e.g., metamaterial surface scattering antenna elements, etc.) of array 419.

This hybrid center-fed and edge-fed structure includes a number of advantages. First, the structure provides independent control of the high band aperture taper/aperture distribution as the guiding structure can be designed so that most of the energy is coupled (and not termination (e.g., absorber) is needed in the waveguides. Second, the hybrid structure provides reduced mechanical complexity in the waveguide bend areas where the wave is redirected from the bottom waveguide to top waveguide. Third, in cases where the high frequency band utilizes less aperture area (e.g., utilize less space), lossy unused transmission line that would appear if both bands were edge-fed would be eliminated. The last two benefits are illustrated in FIG. 4B.

Figure 4B:
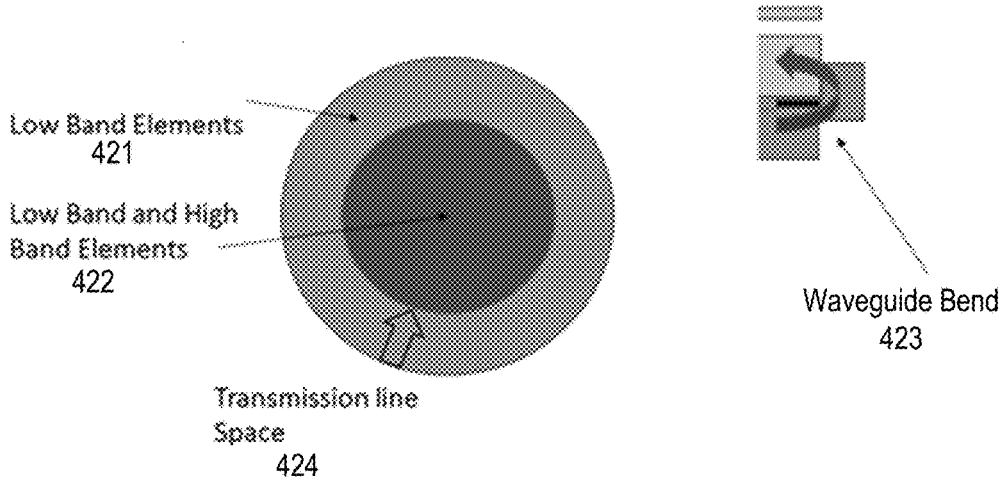
FIG. 4B illustrates the top view of a circular aperture of one embodiment of the hybrid structure of FIG. 4A.

FIG. 4B illustrates the top view of a circular aperture of one embodiment of the hybrid structure of FIG. 4A. Referring to FIG. 4B, the RF radiating antenna elements (e.g., metamaterial surface scattering antenna elements, etc.) that are operated with the low band, referred to herein as low band elements 421, are in the outer portion of the aperture while both RF radiating antenna elements that operate with the low band and the high band are both contained in the inner cylindrical portion of the aperture. The transmission line space 424 between the location in the array of RF radiating antenna elements between the areas that contain only antenna elements that operate with the low band and the area that includes both low band and high band antenna elements would be wasted space if an edge-fed design was used for both bands. Similarly, because only one of the bands, namely the low frequency band 412, employs the edge-fed design to propagate the low frequency band from the lower waveguide 417 to the upper waveguide 416, the complexity in waveguide bend areas 423 is reduced since it does not have to be designed to handle broadband.

Figure 4C:
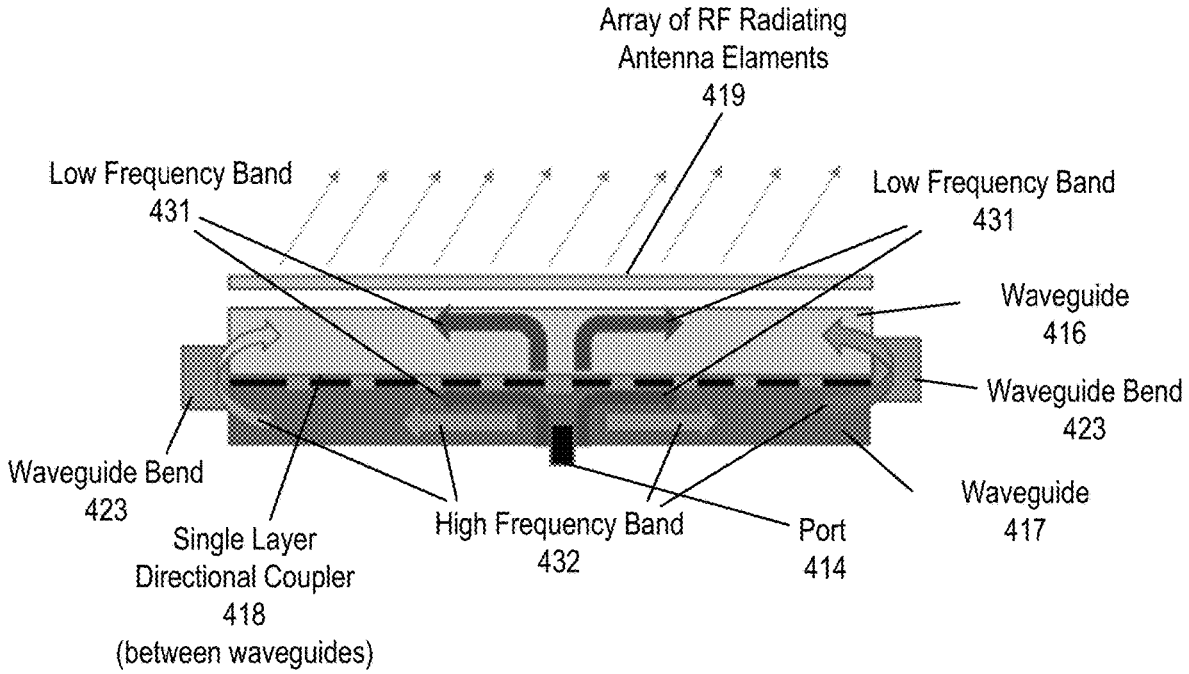
FIG. 4C illustrates a side section view of another embodiment of a hybrid high band/low band guiding structure.

FIG. 4C illustrates a side section view of another embodiment of a hybrid high band/low band guiding structure. In one embodiment, center-fed, single-band low frequency, edge-fed single band high frequency guiding structure is cylindrical when viewed from the top. Referring to FIG. 4C, in this case the directional coupler 418 between waveguides 416 and 417 is designed so that the path of the low frequency band traverses the center-fed guide, while the path of the high frequency band traverses the edge-fed guide. In other words, the high frequency band propagates radially outward from single port 414 to the waveguide bands 423 and traverses up into the upper waveguide 416 via waveguide bands 423, while the path of the low frequency band couples from lower waveguide 417 to upper waveguide 416 through directional coupler 418. In one embodiment, single layer directional coupler 418 is implemented with an inductive-based coupler that allows the low frequency band to be coupled and the high frequency band to not be coupled, so the high frequency band propagates via the edge-fed path. In this way, the feed wave with both low and high frequency bands is able to interface with the RF radiating antenna elements (e.g., metamaterial surface scattering antenna elements, etc.) of array 419.

There are a number of one or more advantages of one or more embodiments of the hybrid guiding structure of FIG. 4C. First, the hybrid guiding structure provides independent control of the low band aperture taper/aperture distribution. Typically, the lower frequency band is more difficult to manage the coupling in an edge-fed guide. In this case, the coupling is managed by the center-fed directional coupler. Second, the hybrid guiding structure provides reduced mechanical complexity in the bend sections 423 where the wave is redirected from the bottom waveguide to the top waveguide since it does not have to be designed to handle broadband.

In another embodiment, the guiding structure is a center-fed, multilayer, multi-band guiding structure. FIGS. 5A-5D illustrate one embodiment of the center-fed, multilayer, multi-band guiding structure. In one embodiment, center-fed, multilayer, multi-band guiding structure is cylindrically-shaped when viewed from the top.

Figure 5A:
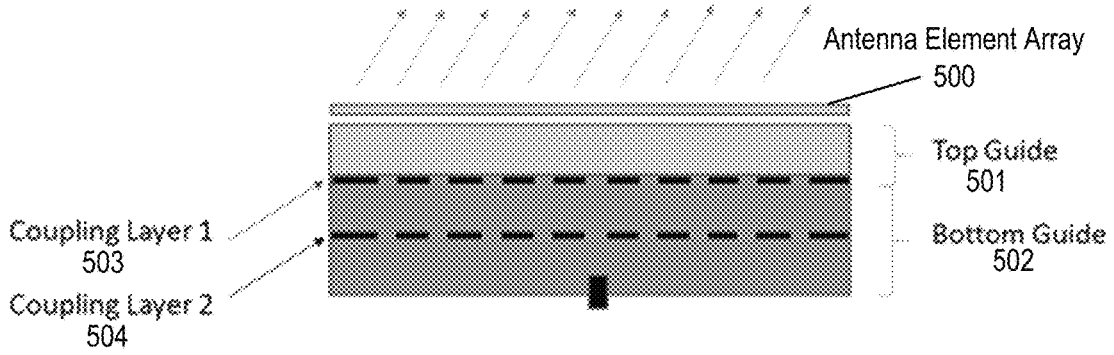
FIGS. 5A-5D illustrate one embodiment of the center-fed, multilayer, multi-band guiding structure.

FIG. 5A illustrates a side section view of one embodiment of the center-fed multi-layer design that includes a center-fed waveguide composed of two separate coupling surfaces. Referring to FIG. 5A, the center-fed guiding structure comprises an antenna element array 500 with RF radiating antenna elements above a top wave guide 501. Top waveguide 501 is above bottom waveguide 502. There is a coupling layer 503 between top waveguide 501 and bottom waveguide 502, while a coupling layer 504 is within bottom waveguide 502.

At one frequency band, coupling layer 503 is visible and coupling layer 504 is not impacting performance. At the other frequency band separated far away (e.g., Ka and Ku band separation), coupling layer 504 is visible and coupling layer 503 is not impacting performance. Note that the definition of the upper and lower waveguide changes based on the frequency characteristics of the layers. This is shown in the FIGS. 5B and 5C.

Figure 5B:
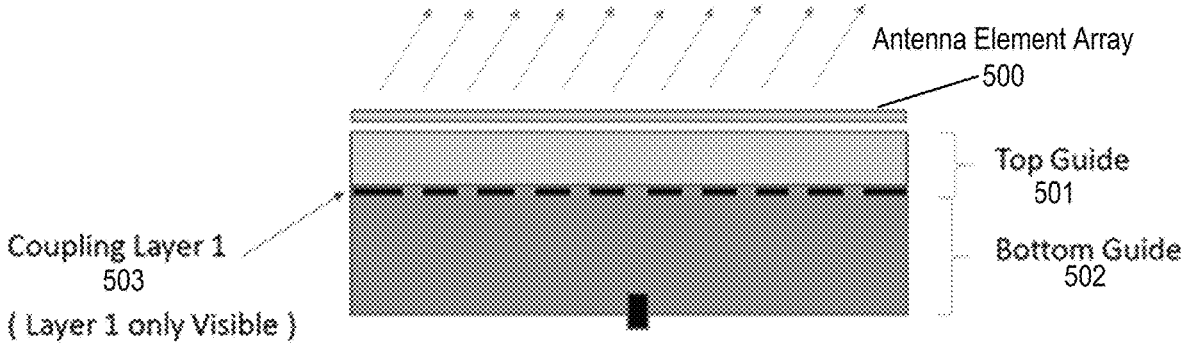
Figure 5C:
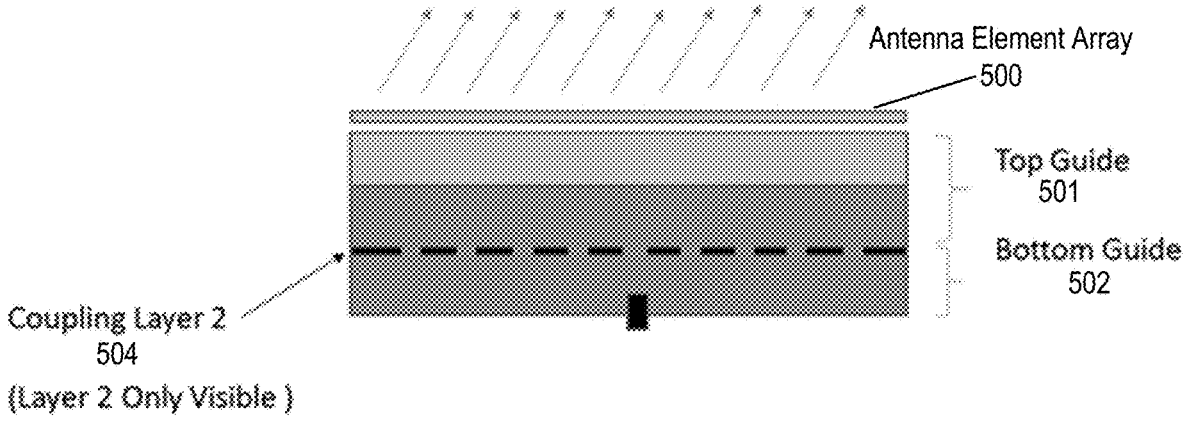
Figure 5D:
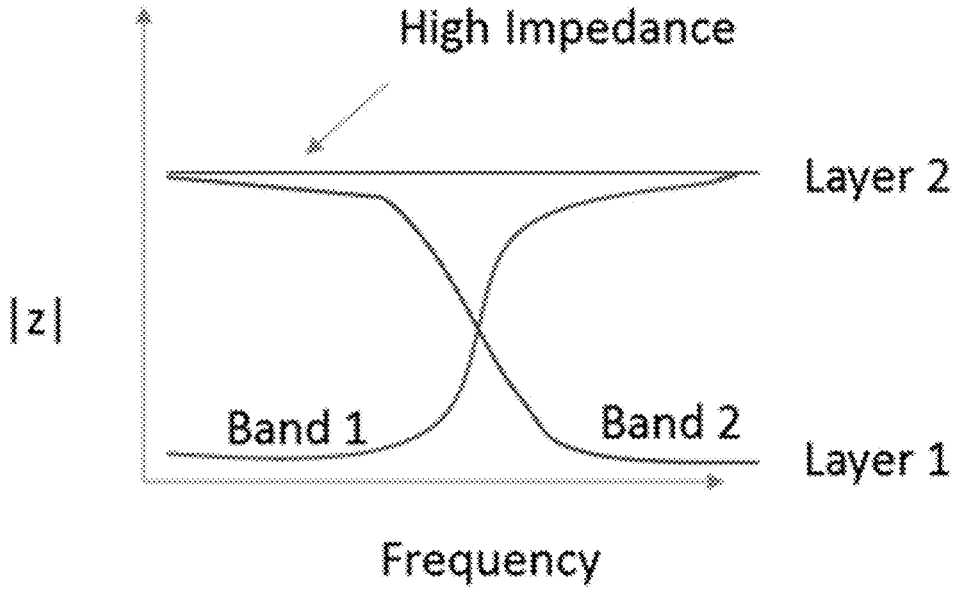

FIG. 5B illustrates a center fed multi-layer implementation for band 1. In this case, coupling layer 503 is the only visible layer to band 1 and the propagation in this case is through coupling layer 503. FIG. 5C illustrates a center fed multi-layer implementation for band 2. Referring to FIG. 5C, in this case, only coupling layer 504 is visible to band 2 and thus the wave propagates through such a layer. In other words, band 1 will have low impedance at a smaller frequency but high impedance at a higher frequency while band 2 has high impendence at a low frequency band yet a low impedance at its frequency with respect to coupling layer 503. The impedance characteristic that could satisfy such a condition is shown in FIG. 5D.

Examples of Antenna Embodiments

The techniques described above may be used with flat panel antennas. Embodiments of such flat panel antennas are disclosed. The flat panel antennas include one or more arrays of antenna elements on an antenna aperture. In one embodiment, the antenna elements comprise liquid crystal cells. In one embodiment, the flat panel antenna is a cylindrically fed antenna that includes matrix drive circuitry to uniquely address and drive each of the antenna elements that are not placed in rows and columns. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

Examples of Antenna Systems

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Antenna Elements

Figure 6:
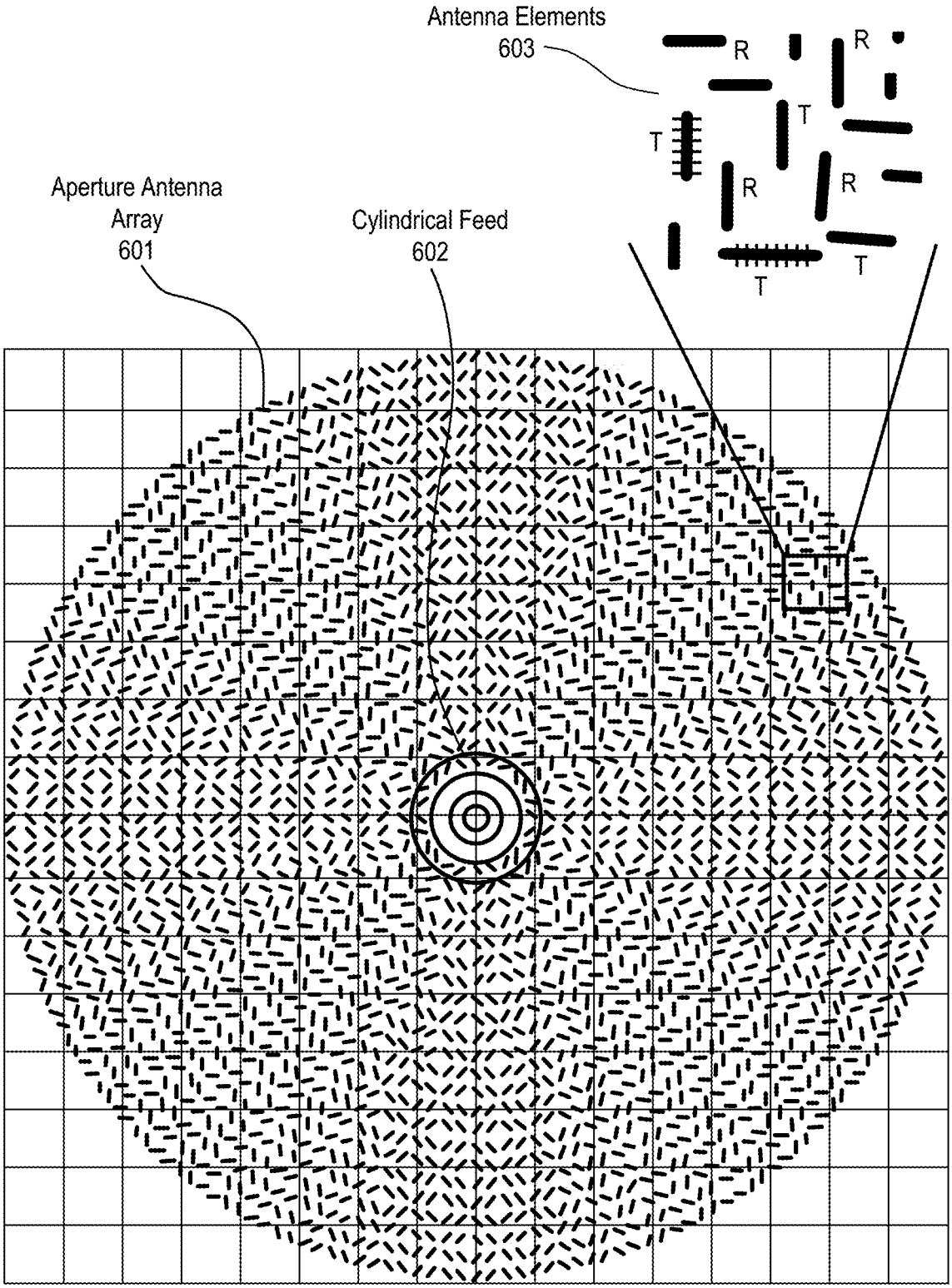
FIG. 6 illustrates an aperture having one or more arrays of antenna elements placed in concentric rings around an input feed of the cylindrically fed antenna.

FIG. 6 illustrates the schematic of one embodiment of a cylindrically fed holographic radial aperture antenna. Referring to FIG. 6, the antenna aperture has one or more arrays 601 of antenna elements 603 that are placed in concentric rings around an input feed 602 of the cylindrically fed antenna. In one embodiment, antenna elements 603 are radio frequency (RF) resonators that radiate RF energy. In one embodiment, antenna elements 603 comprise both Rx and Tx irises that are interleaved and distributed on the whole surface of the antenna aperture. Examples of such antenna elements are described in greater detail below. Note that the RF resonators described herein may be used in antennas that do not include a cylindrical feed.

In one embodiment, the antenna includes a coaxial feed that is used to provide a cylindrical wave feed via input feed 602. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

In one embodiment, antenna elements 603 comprise irises and the aperture antenna of FIG. 6 is used to generate a main beam shaped by using excitation from a cylindrical feed wave for radiating irises through tunable liquid crystal (LC) material. In one embodiment, the antenna can be excited to radiate a horizontally or vertically polarized electric field at desired scan angles.

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor. As would be understood by those skilled in the art, LC in the context of CELC refers to inductance-capacitance, as opposed to liquid crystal.

In one embodiment, a liquid crystal (LC) is disposed in the gap around the scattering element. This LC is driven by the direct drive embodiments described above. In one embodiment, liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty-five-degree(45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, as discussed above, a matrix drive is used to apply voltage to the patches in order to drive each cell separately from all the other cells without having a separate connection for each cell (direct drive). Because of the high density of elements, the matrix drive is an efficient way to address each cell individually.

In one embodiment, the control structure for the antenna system has 2 main components: the antenna array controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude or duty cycle of an AC bias signal to that element.

In one embodiment, the antenna array controller also contains a microprocessor executing the software. The control structure may also incorporate sensors (e.g., a GPS receiver, a three-axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the antenna array controller controls which elements are turned off and those elements turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 7:
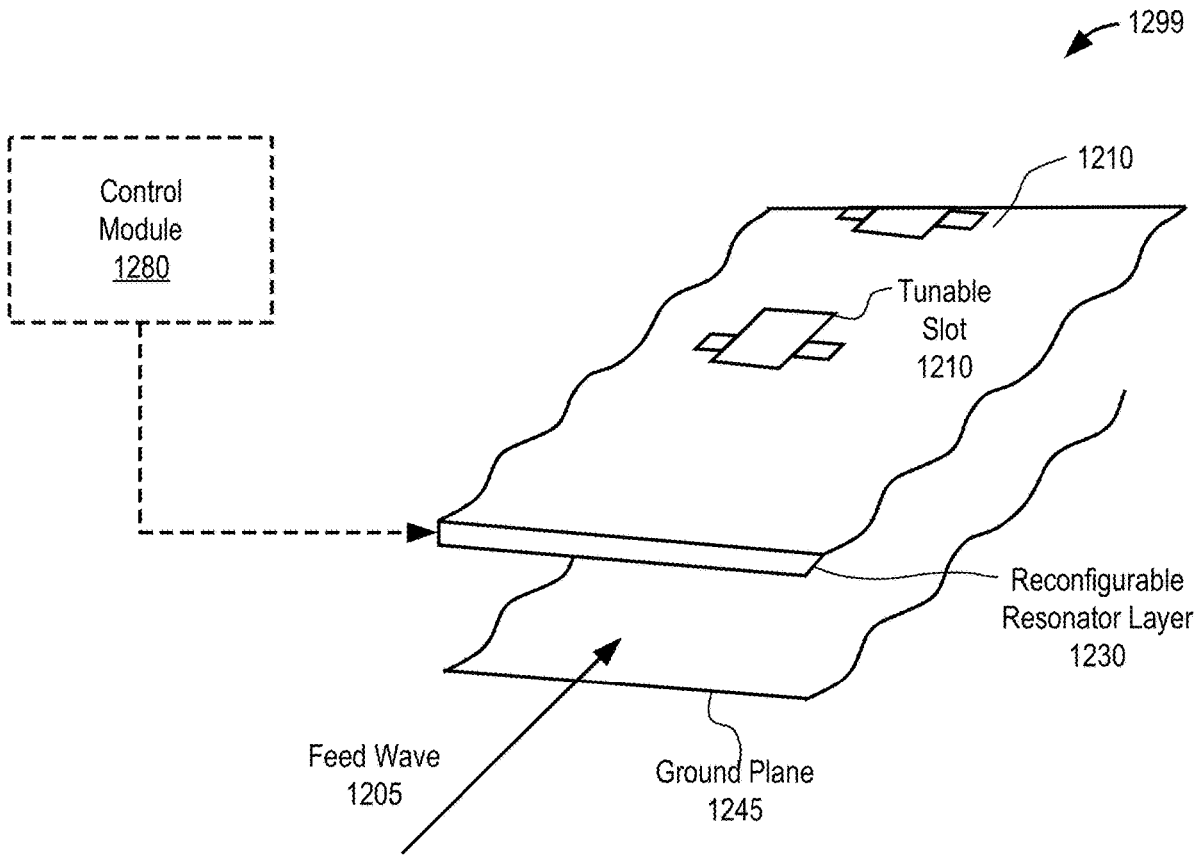
FIG. 7 illustrates a perspective view of one row of antenna elements that includes a ground plane and a reconfigurable resonator layer.

FIG. 7 illustrates a perspective view of one row of antenna elements that includes a ground plane and a reconfigurable resonator layer. Reconfigurable resonator layer 1230 includes an array of tunable slots 1210. The array of tunable slots 1210 can be configured to point the antenna in a desired direction. Each of the tunable slots can be tuned/adjusted by varying a voltage across the liquid crystal.

Figure 8A:
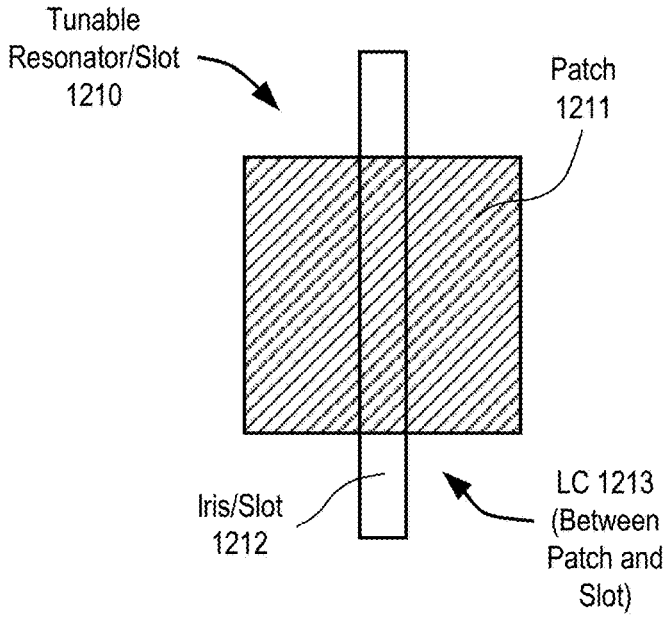
FIG. 8A illustrates one embodiment of a tunable resonator/slot.

Control module 1280 is coupled to reconfigurable resonator layer 1230 to modulate the array of tunable slots 1210 by varying the voltage across the liquid crystal in FIG. 8A. Control module 1280 may include a Field Programmable Gate Array ("FPGA"), a microprocessor, a controller, System-on-a-Chip (SoC), or other processing logic. In one embodiment, control module 1280 includes logic circuitry (e.g., multiplexer) to drive the array of tunable slots 1210. In one embodiment, control module 1280 receives data that includes specifications for a holographic diffraction pattern to be driven onto the array of tunable slots 1210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 1280 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w_{in}*w_{out}$, with $w_{in}$ as the wave equation in the waveguide and $w_{out}$ the wave equation on the outgoing wave.

FIG. 8A illustrates one embodiment of a tunable resonator/slot 1210. Tunable slot 1210 includes an iris/slot 1212, a radiating patch 1211, and liquid crystal 1213 disposed between iris 1212 and patch 1211. In one embodiment, radiating patch 1211 is co-located with iris 1212.

Figure 8B:
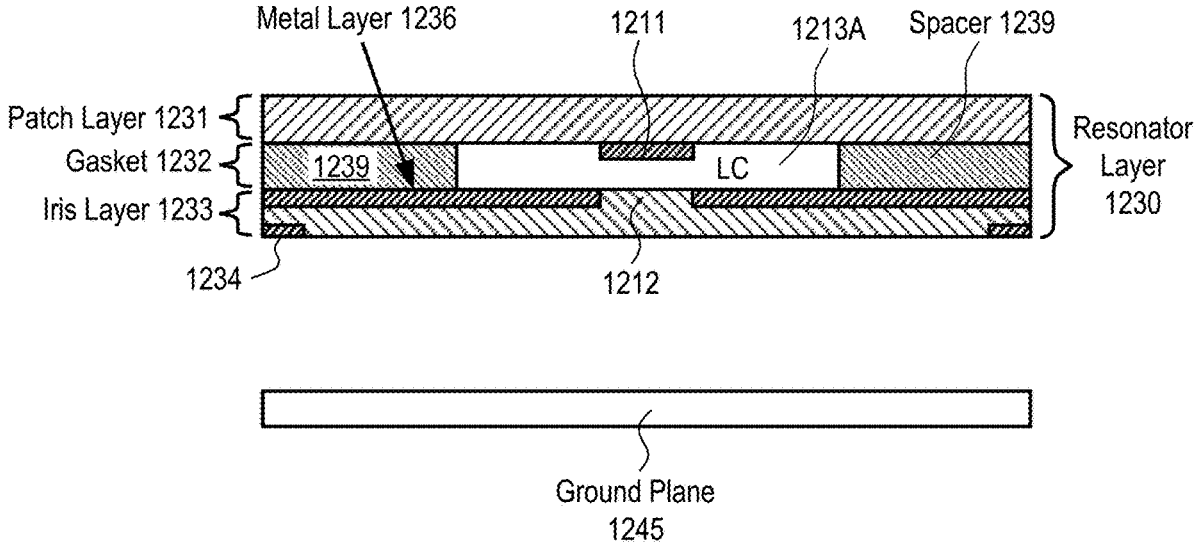
FIG. 8B illustrates a cross section view of one embodiment of a physical antenna aperture.

FIG. 8B illustrates a cross section view of one embodiment of a physical antenna aperture. The antenna aperture includes ground plane 1245, and a metal layer 1236 within iris layer 1233, which is included in reconfigurable resonator layer 1230. In one embodiment, the antenna aperture of FIG. 8B includes a plurality of tunable resonator/slots 1210 of FIG. 8A. Iris/slot 1212 is defined by openings in metal layer 1236. A feed wave, such as feed wave 1205 of FIG. 8A, may have a microwave frequency compatible with satellite communication channels. The feed wave propagates between ground plane 1245 and resonator layer 1230.

Reconfigurable resonator layer 1230 also includes gasket layer 1232 and patch layer 1231. Gasket layer 1232 is disposed between patch layer 1231 and iris layer 1233. Note that in one embodiment, a spacer could replace gasket layer 1232. In one embodiment, iris layer 1233 is a printed circuit board ("PCB") that includes a copper layer as metal layer 1236. In one embodiment, iris layer 1233 is glass. Iris layer 1233 may be other types of substrates.

Openings may be etched in the copper layer to form slots 1212. In one embodiment, iris layer 1233 is conductively coupled by a conductive bonding layer to another structure (e.g., a waveguide) in FIG. 8B. Note that in an embodiment the iris layer is not conductively coupled by a conductive bonding layer and is instead interfaced with a non-conducting bonding layer.

Patch layer 1231 may also be a PCB that includes metal as radiating patches 1211. In one embodiment, gasket layer 1232 includes spacers 1239 that provide a mechanical standoff to define the dimension between metal layer 1236 and patch 1211. In one embodiment, the spacers are 75 microns, but other sizes may be used (e.g., 3-200 mm). As mentioned above, in one embodiment, the antenna aperture of FIG. 8B includes multiple tunable resonator/slots, such as tunable resonator/slot 1210 includes patch 1211, liquid crystal 1213, and iris 1212 of FIG. 8A. The chamber for liquid crystal 1213 is defined by spacers 1239, iris layer 1233 and metal layer 1236. When the chamber is filled with liquid crystal, patch layer 1231 can be laminated onto spacers 1239 to seal liquid crystal within resonator layer 1230.

A voltage between patch layer 1231 and iris layer 1233 can be modulated to tune the liquid crystal in the gap between the patch and the slots (e.g., tunable resonator/slot 1210). Adjusting the voltage across liquid crystal 1213 varies the capacitance of a slot (e.g., tunable resonator/slot 1210). Accordingly, the reactance of a slot (e.g., tunable resonator/slot 1210) can be varied by changing the capacitance. Resonant frequency of slot 1210 also changes according to the equation $$f = \frac{1}{2\pi\sqrt{LC}}$$

where f is the resonant frequency of slot 1210 and L and C are the inductance and capacitance of slot 1210, respectively. The resonant frequency of slot 1210 affects the energy radiated from feed wave 1205 propagating through the waveguide. As an example, if feed wave 1205 is 20 GHz, the resonant frequency of a slot 1210 may be adjusted (by varying the capacitance) to 17 GHz so that the slot 1210 couples substantially no energy from feed wave 1205. Or, the resonant frequency of a slot 1210 may be adjusted to 20 GHz so that the slot 1210 couples energy from feed wave 1205 and radiates that energy into free space. Although the examples given are binary (fully radiating or not radiating at all), full gray scale control of the reactance, and therefore the resonant frequency of slot 1210 is possible with voltage variance over a multi-valued range. Hence, the energy radiated from each slot 1210 can be finely controlled so that detailed holographic diffraction patterns can be formed by the array of tunable slots.

In one embodiment, tunable slots in a row are spaced from each other by λ/5. Other spacing may be used. In one embodiment, each tunable slot in a row is spaced from the closest tunable slot in an adjacent row by λ/2, and, thus, commonly oriented tunable slots in different rows are spaced by λ/4, though other spacings are possible (e.g., λ/5, λ/6.3). In another embodiment, each tunable slot in a row is spaced from the closest tunable slot in an adjacent row by λ/3.

Embodiments use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015.

FIGS. 9A-D illustrate one embodiment of the different layers for creating the slotted array. The antenna array includes antenna elements that are positioned in rings, such as the example rings shown in FIG. 1A. Note that in this example the antenna array has two different types of antenna elements that are used for two different types of frequency bands.

Figure 9A:
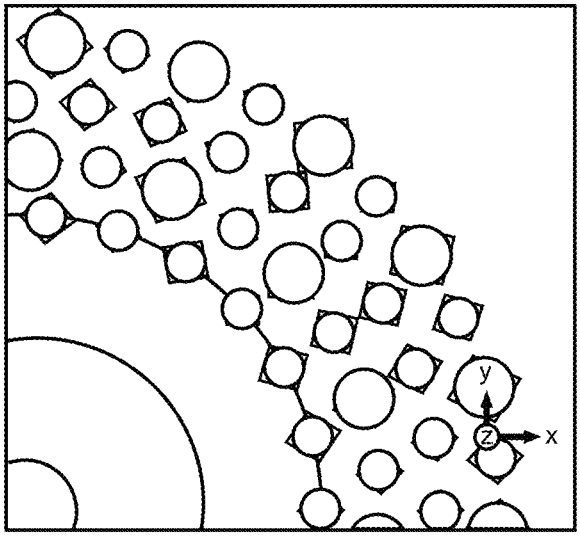
FIGS. 9A-D illustrate one embodiment of the different layers for creating the slotted array.
Figure 9B:
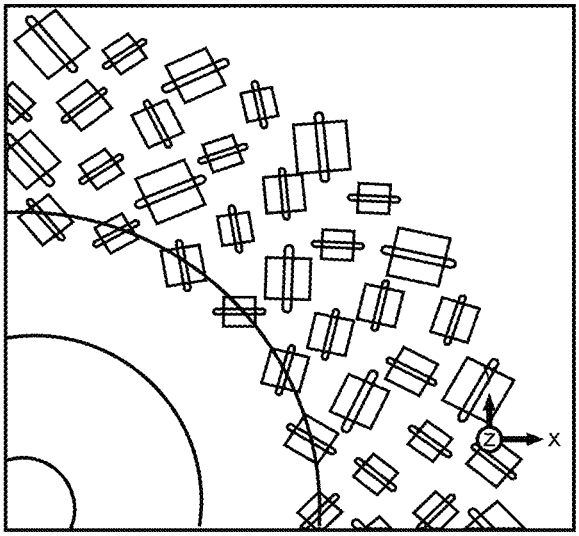
Figure 9C:
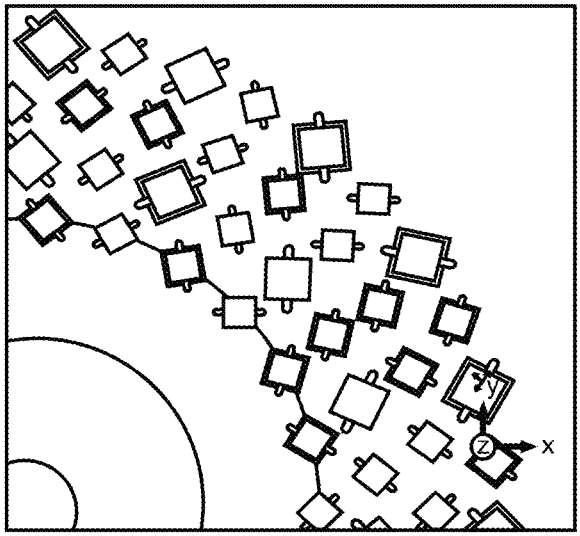
Figure 9D:
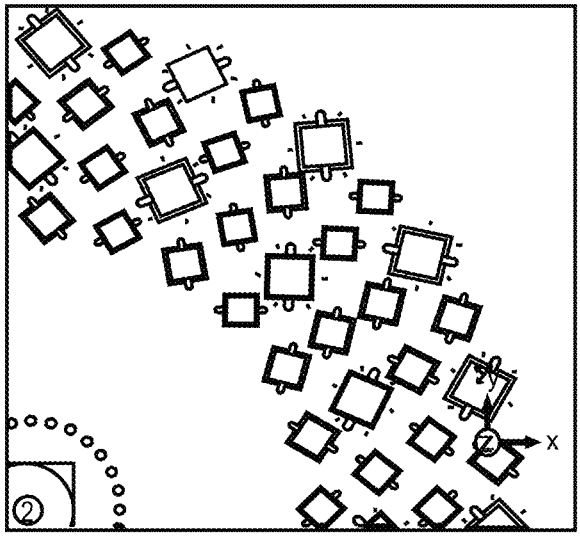

FIG. 9A illustrates a portion of the first iris board layer with locations corresponding to the slots. Referring to FIG. 9A, the circles are open areas/slots in the metallization in the bottom side of the iris substrate, and are for controlling the coupling of elements to the feed (the feed wave). Note that this layer is an optional layer and is not used in all designs. FIG. 9B illustrates a portion of the second iris board layer containing slots. FIG. 9C illustrates patches over a portion of the second iris board layer. FIG. 9D illustrates a top view of a portion of the slotted array.

Figure 10:
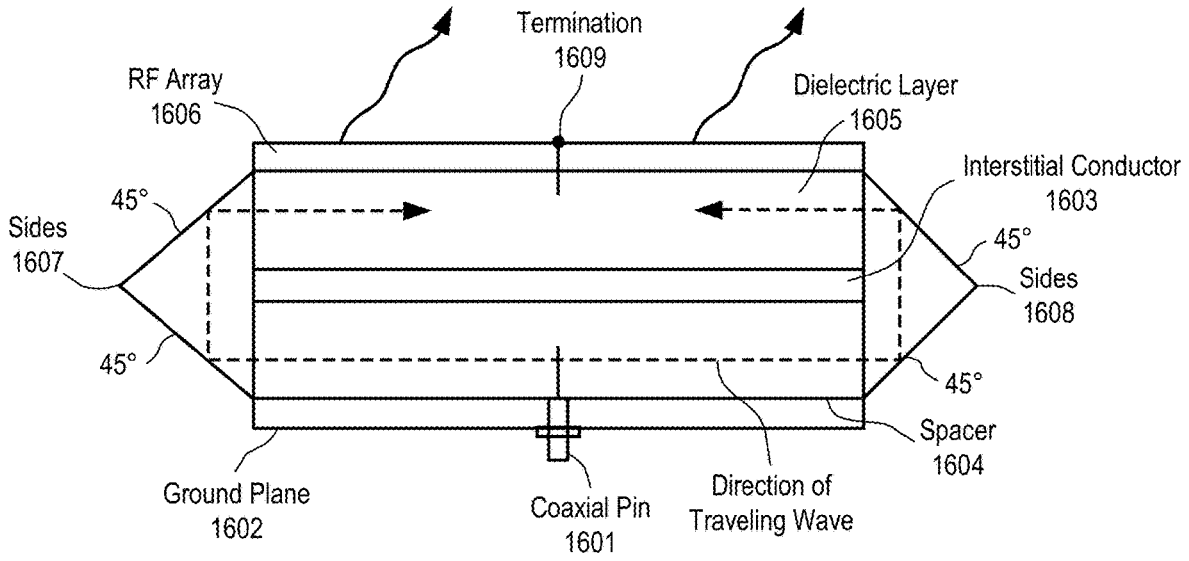
FIG. 10 illustrates a side view of one embodiment of a cylindrically fed antenna structure.

FIG. 10 illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 10 includes a coaxial feed, such as, for example, described in U.S. Publication No. 2015/0236412, entitled "Dynamic Polarization and Coupling Control from a Steerable Cylindrically Fed Holographic Antenna", filed on Nov. 21, 2014.

Referring to FIG. 10, a coaxial pin 1601 is used to excite the field on the lower level of the antenna. In one embodiment, coaxial pin 1601 is a 50Ω coax pin that is readily available. Coaxial pin 1601 is coupled (e.g., bolted) to the bottom of the antenna structure, which is conducting ground plane 1602. Separate from conducting ground plane 1602 is interstitial conductor 1603, which is an internal conductor. In one embodiment, conducting ground plane 1602 and interstitial conductor 1603 are parallel to each other. In one embodiment, the distance between ground plane 1602 and interstitial conductor 1603 is 0.1-0.15". In another embodiment, this distance may be λ/2, where λ, is the wavelength of the travelling wave at the frequency of operation.

Ground plane 1602 is separated from interstitial conductor 1603 via a spacer 1604. In one embodiment, spacer 1604 is a foam or air-like spacer. In one embodiment, spacer 1604 comprises a plastic spacer.

On top of interstitial conductor 1603 is dielectric layer 1605. In one embodiment, dielectric layer 1605 is plastic. The purpose of dielectric layer 1605 is to slow the travelling wave relative to free space velocity. In one embodiment, dielectric layer 1605 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1605, such as periodic sub-wavelength metallic structures that can be machined or lithographically defined, for example.

An RF-array 1606 is on top of dielectric 1605. In one embodiment, the distance between interstitial conductor 1603 and RF-array 1606 is 0.1-0.15". In another embodiment, this distance may be $\lambda_{eff}/2$, where $\lambda_{eff}$ is the effective wavelength in the medium at the design frequency.

The antenna includes sides 1607 and 1608. Sides 1607 and 1608 are angled to cause a travelling wave feed from coax pin 1601 to be propagated from the area below interstitial conductor 1603 (the spacer layer) to the area above interstitial conductor 1603 (the dielectric layer) via reflection. In one embodiment, the angle of sides 1607 and 1608 are at 45° angles. In an alternative embodiment, sides 1607 and 1608 could be replaced with a continuous radius to achieve the reflection. While FIG. 10 shows angled sides that have an angle of 45 degrees, other angles that accomplish signal transmission from the lower-level feed to the upper-level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step. The steps on one end of the antenna go around the dielectric layer, interstitial the conductor, and the spacer layer. The same two steps are at the other ends of these layers.

In operation, when a feed wave is fed in from coaxial pin 1601, the wave travels outward concentrically oriented from coaxial pin 1601 in the area between ground plane 1602 and interstitial conductor 1603. The concentrically outgoing waves are reflected by sides 1607 and 1608 and travel inwardly in the area between interstitial conductor 1603 and RF array 1606. The reflection from the edge of the circular perimeter causes the wave to remain in phase (i.e., it is an in-phase reflection). The travelling wave is slowed by dielectric layer 1605. At this point, the travelling wave starts interacting and exciting with elements in RF array 1606 to obtain the desired scattering.

To terminate the travelling wave, a termination 1609 is included in the antenna at the geometric center of the antenna. In one embodiment, termination 1609 comprises a pin termination (e.g., a 50Ω pin). In another embodiment, termination 1609 comprises an RF absorber that terminates unused energy to prevent reflections of that unused energy back through the feed structure of the antenna. These could be used at the top of RF array 1606.

Figure 11:
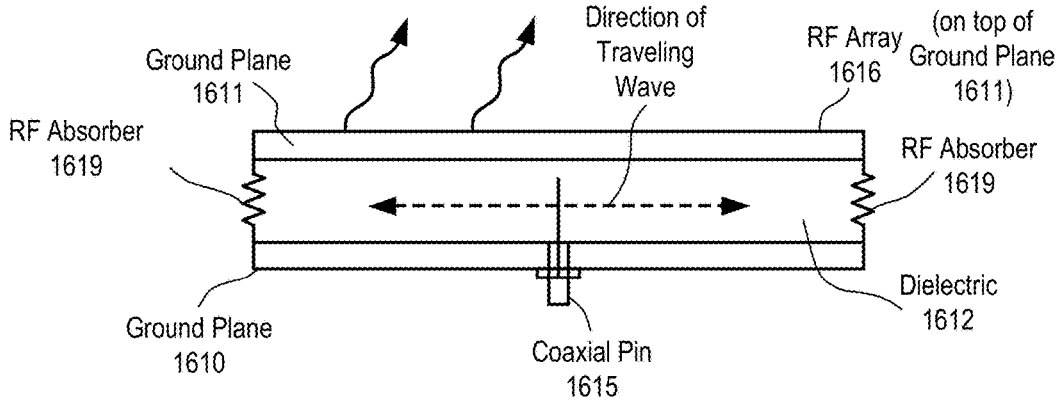
FIG. 11 illustrates another embodiment of the antenna system with an outgoing wave.

FIG. 11 illustrates another embodiment of the antenna system with an outgoing wave. Referring to FIG. 11, two ground planes 1610 and 1611 are substantially parallel to each other with a dielectric layer 1612 (e.g., a plastic layer, etc.) in between ground planes. RF absorbers 1619 (e.g., resistors) couple the two ground planes 1610 and 1611 together. A coaxial pin 1615 (e.g., 50Ω) feeds the antenna. An RF array 1616 is on top of dielectric layer 1612 and ground plane 1611.

In operation, a feed wave is fed through coaxial pin 1615 and travels concentrically outward and interacts with the elements of RF array 1616.

The cylindrical feed in both the antennas of FIGS. 10 and 11 improves the service angle of the antenna. Instead of a service angle of plus or minus forty-five degrees azimuth (±45° Az) and plus or minus twenty-five degrees elevation (±25° E1), in one embodiment, the antenna system has a service angle of seventy-five degrees(75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1606 of FIG. 10 and RF array 1616 of FIG. 11 include a wave scattering subsystem that includes a group of patch antennas (i.e., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty-five-degree(45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 12:
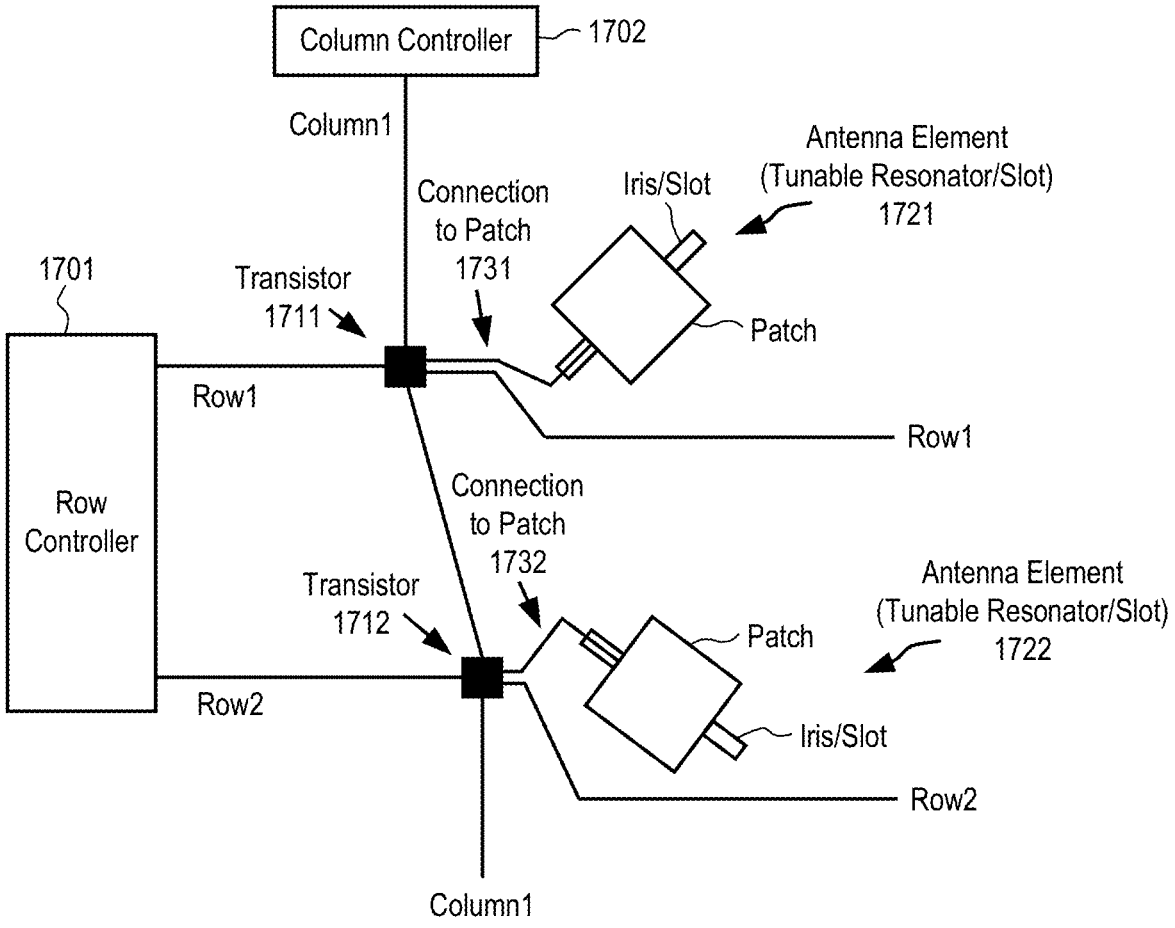
FIG. 12 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 12 illustrates one embodiment of the placement of matrix drive circuitry with respect to antenna elements. Referring to FIG. 12, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercially available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 13:
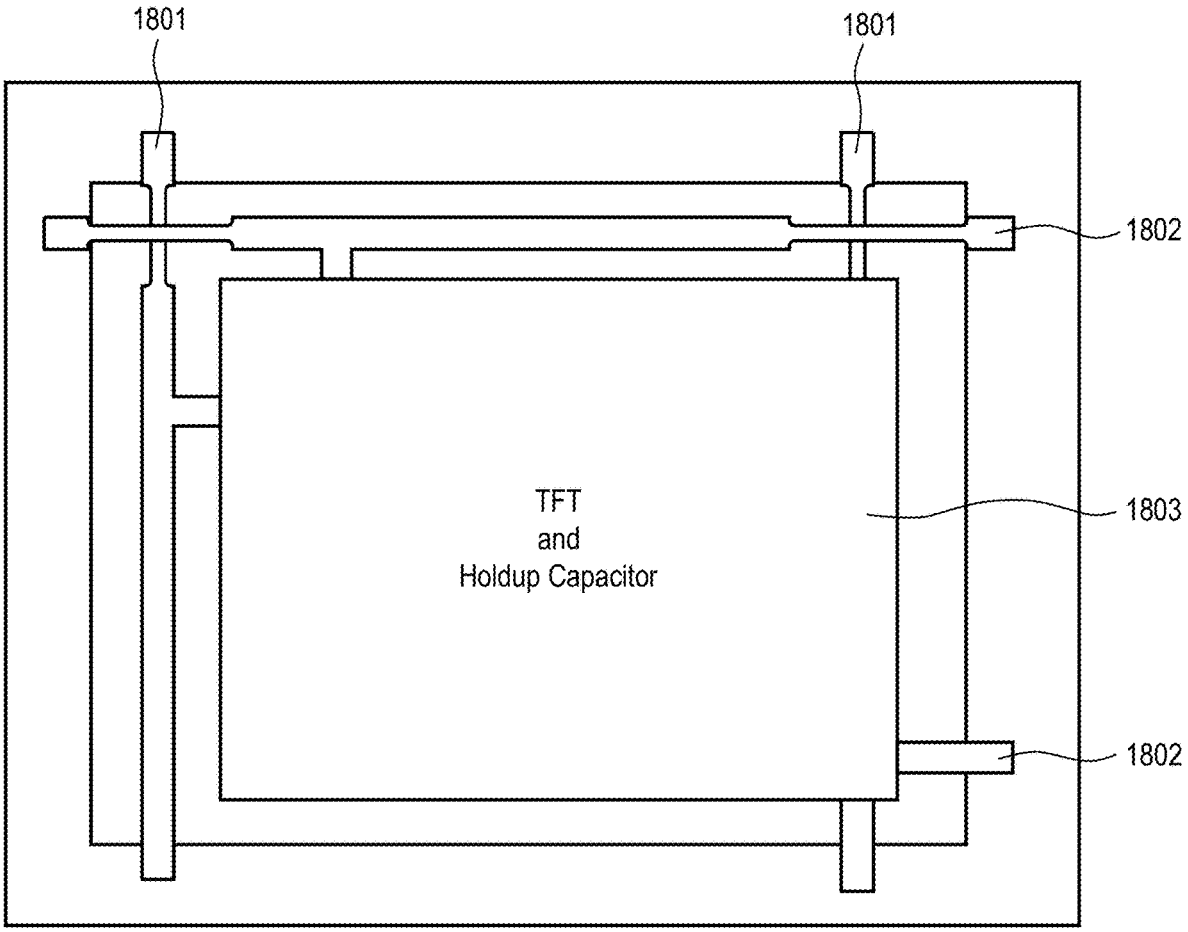
FIG. 13 illustrates one embodiment of a TFT package.

In one embodiment, a TFT package is used to enable placement and unique addressing in the matrix drive. FIG. 13 illustrates one embodiment of a TFT package. Referring to FIG. 13, a TFT and a hold capacitor 1803 is shown with input and output ports. There are two input ports connected to traces 1801 and two output ports connected to traces 1802 to connect the TFTs together using the rows and columns. In one embodiment, the row and column traces cross in 90° angles to reduce, and potentially minimize, the coupling between the row and column traces. In one embodiment, the row and column traces are on different layers.

An Example of a Full Duplex Communication System

Figure 14:
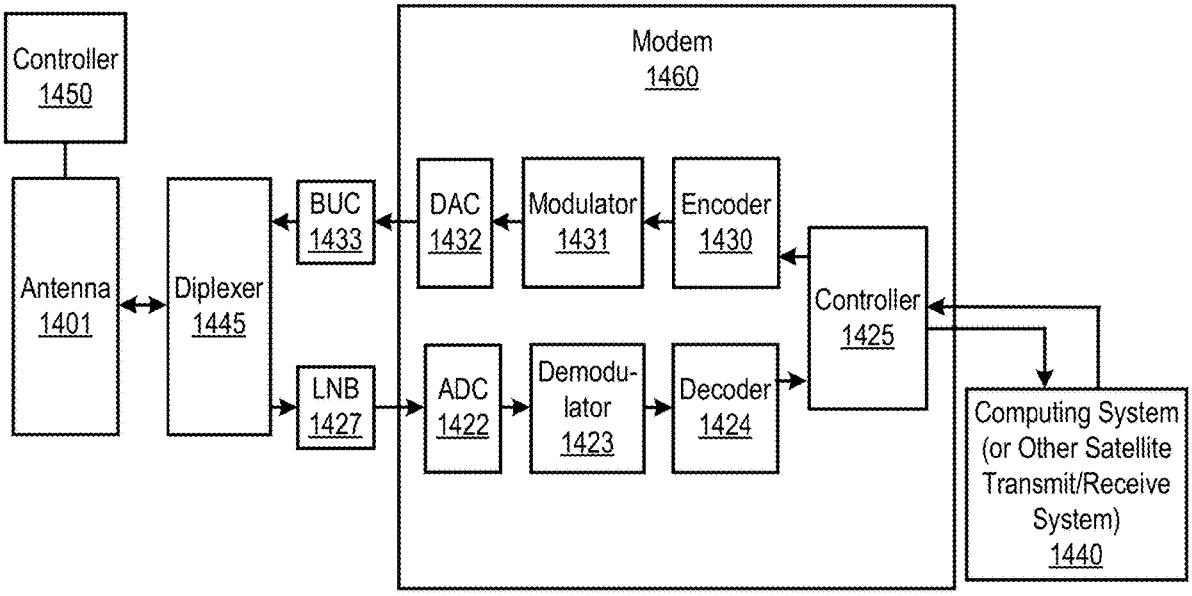
FIG. 14 is a block diagram of another embodiment of a communication system having simultaneous transmit and receive paths.

In another embodiment, the combined antenna apertures are used in a full duplex communication system. FIG. 14 is a block diagram of another embodiment of a communication system having simultaneous transmit and receive paths. While only one transmit path and one receive path are shown, the communication system may include more than one transmit path and/or more than one receive path.

Referring to FIG. 14, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNBs) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (upconvert and high pass amplifier) 1433 and provided to one port of diplexer 1445. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

The communication system would be modified to include the combiner/arbiter described above. In such a case, the combiner/arbiter after the modem but before the BUC and LNB.

Note that the full duplex communication system shown in FIG. 14 has a number of applications, including but not limited to, internet communication, vehicle communication (including software updating), etc.

There is a number of example embodiments described herein.

Example 1 is an antenna comprising: an antenna aperture with radio-frequency (RF) radiating antenna elements; and a center-fed, multi-band wave guiding structure coupled to the antenna aperture to receive a feed wave in two different frequency bands and propagate the feed wave to the RF radiating antenna elements of the antenna aperture.

Example 2 is the antenna of example 1 that may optionally include that the guiding structure is a directional coupler guiding structure.

Example 3 is the antenna of example 1 that may optionally include that the directional coupler guiding structure comprises a bottom guide and a top guide operable to perform coupling of a first single frequency band of the two different frequency bands while a second single frequency band of the two different frequency bands propagates radially outward to outer edges of the bottom guide and reflects up into the top guide to be edge-fed to RF radiating antenna elements of the antenna aperture.

Example 4 is the antenna of example 3 that may optionally include that the first single frequency band is higher in frequency than the second single frequency band.

Example 5 is the antenna of example 3 that may optionally include that the second single frequency band is higher in frequency than the first single frequency band.

Example 6 is the antenna of example 1 that may optionally include that the guiding structure comprises: a top guide; a bottom guide; and a directional coupler between the top guide and the bottom guide and having a frequency response to pass the first band.

Example 7 is the antenna of example 1 that may optionally include that the directional coupler comprises a plurality of coupling elements and a size of one or more coupling elements of the plurality of coupling elements are electrically or physically changeable.

Example 8 is the antenna of example 1 that may optionally include that the first and second frequency bands comprises two satellite communication bands.

Example 9 is the antenna of example 8 that may optionally include that the first and second frequency bands comprise Ku and Ka bands.

Example 10 is a multi-band antenna comprising: an antenna aperture with radio-frequency (RF) radiating antenna elements; and a guiding structure to propagate a feed wave in first and second bands at different frequencies, the guiding structure having first and second layers with first and second impedances, respectively, separated by a distance to create different spatial frequency responses for the first and second bands.

Example 11 is the multi-band antenna of example 10 that may optionally include that the guiding structure comprises a center-fed guide and an edge-fed guide, wherein the first band at a first frequency traverses the center-fed guide and the second band at a second frequency traverses the edge-fed guide structure.

Example 12 is the multi-band antenna of example 11 that may optionally include that the first frequency is higher than the second frequency.

Example 13 is the multi-band antenna of example 11 that may optionally include that the second frequency is higher than the first frequency.

Example 14 is the multi-band antenna of example 10 that may optionally include that the guiding structure comprises: a top guide; a bottom guide; and a directional coupler between the top guide and the bottom guide and having a frequency response to pass the first band.

Example 15 is the multi-band antenna of example 14 that may optionally include that the first band is at a higher frequency that the second band.

Example 16 is the multi-band antenna of example 14 that may optionally include that the first band at a lower frequency that the second band.

Example 17 is the multi-band antenna of example 14 that may optionally include that the directional coupler comprises a plurality of coupling elements and a size of one or more coupling elements of the plurality of coupling elements are electrically changeable.

Example 18 is the multi-band antenna of example 10 that may optionally include that the directional coupler comprises a plurality of coupling elements and a size of one or more coupling elements of the plurality of coupling elements are physically changeable.

Example 19 is the multi-band antenna of example 10 that may optionally include that the first and second bands comprises two satellite communication bands.

Example 20 is the multi-band antenna of example 10 that may optionally include that the first and second bands comprise Ku and Ka bands.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

What is claimed is:

1. A method comprising:

receiving, with a center-fed, multi-band wave guiding structure, a feed wave in two different frequency bands separated in frequency;

propagating, with the center-fed, multi-band wave guiding structure, the feed wave to a plurality of RF radiating antenna elements of an antenna aperture coupled to the center-fed, multi-band wave guiding structure, the two different frequency bands having different propagation paths in the guiding structure to the RF radiating antenna elements; and generating one or more beams by interacting the feed wave having the two frequency bands with RF radiating antenna elements of the plurality of RF radiating antenna elements to excite the RF radiating antenna elements.

2. The method of claim 1 wherein the guiding structure is a directional coupler guiding structure.

3. The method of claim 1 wherein the directional coupler guiding structure comprises a bottom guide and a top guide operable, wherein propagating, with the center-fed, multi-band wave guiding structure, the feed wave to the plurality of RF radiating antenna elements comprises propagating a second single frequency band of the two different frequency bands radially outward to outer edges of the bottom guide and reflecting up the second single frequency band into the top guide to be edge-fed to RF radiating antenna elements of the antenna aperture, and further comprising:

coupling a first single frequency band of the two different frequency bands while the second single frequency band of the two different frequency bands propagates radially outward to the outer edges of the bottom guide and reflects up into the top guide.

4. The method of claim 3 wherein the first single frequency band is higher in frequency than the second single frequency band.

5. The method of claim 3 wherein the second single frequency band is higher in frequency than the first single frequency band.

6. The method of claim 1 wherein the first and second frequency bands comprises two satellite communication bands.

7. The method of claim 6 wherein the first and second frequency bands comprise Ku and Ka bands.

8. An antenna comprising:

an antenna aperture with a plurality of radio-frequency (RF) radiating antenna elements; and a center-fed, multi-band wave guiding structure coupled to the antenna aperture to receive a feed wave in two different frequency bands separated in frequency and propagate the feed wave to the plurality of RF radiating antenna elements of the antenna aperture to have the feed wave with the two frequency bands interact with RF radiating antenna elements of the plurality, wherein the guiding structure comprises a directional coupler within its interior and having a frequency response to pass a first band of the two frequency bands from one portion of the guiding structure to another portion of the guiding structure, wherein the directional coupler comprises a plurality of coupling elements and one or more coupling elements of the plurality of coupling elements are electrically or physically changeable to dynamically change a spatial filter response of the directional coupler.

9. The antenna of claim 8 wherein size of the one or more coupling elements of the plurality of coupling elements is changed to set the spatial filter response of the directional coupler to permit each of the one or more coupling elements to pass one of the two frequency bands.

10. The antenna of claim 9 wherein the directional coupler includes two layers moveable with respect to each other to adjust the size of the one or more coupling elements.

11. The antenna of claim 10 wherein the one or more coupling elements comprises windows and the two layers are moved with respect to each other to adjust the window size of the one or more coupling elements.

12. The antenna of claim 9 wherein the one or more coupling elements comprises windows and electrical length of the windows is modified electrically to set each of the one or more coupling elements to pass one of the two frequency bands.

13. The antenna of claim 8 wherein the one or more coupling elements of the plurality of coupling elements are changed to set coupling coefficients to one of the two frequency bands.

14. The antenna of claim 8 wherein the directional coupler includes capacitors and the one or more coupling elements of the plurality of coupling elements are changed by tuning capacitance.

15. The antenna of claim 8 wherein the guiding structure further comprises: a top guide and a bottom guide with the directional coupler between the top guide and the bottom guide to pass the first band from the bottom guide to the top guide.

16. An antenna comprising:

an antenna aperture with a plurality of radio-frequency (RF) radiating antenna elements; and a center-fed, multi-band wave guiding structure coupled to the antenna aperture to receive a feed wave in two different frequency bands separated in frequency and propagate the feed wave to the plurality of RF radiating antenna elements of the antenna aperture to have the feed wave with the two frequency bands interact with RF radiating antenna elements of the plurality, wherein the guiding structure comprises a directional coupler within its interior and having a frequency response to pass a first band of the two frequency bands from one portion of the guiding structure to another portion of the guiding structure, wherein the directional coupler comprises a plurality of coupling elements and impedance characteristics of one or more coupling elements of the plurality of coupling elements are set to control a spatial filter response of the directional coupler.

17. The antenna of claim 16 wherein the impedance characteristic of the one or more coupling elements of the plurality of coupling elements is set by setting a coupling rate of the one or more coupling elements.

18. The antenna of claim 17 wherein setting the coupling rate of the one or more coupling elements also sets a frequency for which each of the one or more coupling elements is set to operate.

19. The antenna of claim 17 wherein each of the one or more coupling elements has a hole or slot size, and the coupling rate of the one or more coupling elements is set by setting the hole or slot size of one or more coupling elements.

20. The antenna of claim 17 wherein the impedance characteristic of each of the one or more coupling elements is set by inclusion of inductive and/or capacitive elements in the directional coupler near the one or more coupling elements.

21. An antenna comprising:

an antenna aperture with a plurality of radio-frequency (RF) radiating antenna elements; and a center-fed, multi-band wave guiding structure coupled to the antenna aperture to receive a feed wave in two different frequency bands separated in frequency and propagate the feed wave to the plurality of RF radiating antenna elements of the antenna aperture to have the feed wave with the two frequency bands interact with RF radiating antenna elements of the plurality, wherein the guiding structure comprises wherein the guiding structure comprises:

a top guide, a bottom guide below the top guide, a first coupling layer between the top guide and the bottom guide, and a second coupling layer within the bottom guide, wherein the first coupling layer is visible at a first frequency band such that the feed wave propagates through the first coupling layer and does not impact performance at a second frequency band, and the second coupling layer is visible at the second frequency band such that the feed wave propagates through the second coupling layer and does not impact performance at the first frequency band, the first and second frequency bands being different.

22. The antenna of claim 21 wherein the first and second frequency bands are the Ka and Ku bands.

23. The antenna of claim 21 wherein the first coupling layer has low impedance at the first frequency band and high impedance at the second frequency band, and the second coupling layer has low impedance at the second frequency band and high impedance at the first frequency band.

* * * * *